US010400396B2

(12) United States Patent
Kernwein et al.

(10) Patent No.: US 10,400,396 B2
(45) Date of Patent: Sep. 3, 2019

(54) SWITCH ALIGNMENT DETECTION ENFORCEMENT SYSTEM AND METHOD

(71) Applicant: Westinghouse Air Brake Technologies Corporation, Wilmerding, PA (US)

(72) Inventors: Jeffrey D. Kernwein, Cedar Rapids, IA (US); James H. Moore, Cedar Rapids, IA (US)

(73) Assignee: Westinghouse Air Brake Technologies Corporation, Wilmerding, PA (US)

( * ) Notice: Subject to any disclaimer, the term of this patent is extended or adjusted under 35 U.S.C. 154(b) by 0 days.

(21) Appl. No.: 14/636,781

(22) Filed: Mar. 3, 2015

(65) Prior Publication Data

US 2016/0257325 A1 Sep. 8, 2016

(51) Int. Cl.

| | |
|---|---|
| ***B61L 27/04*** | (2006.01) |
| ***B61L 23/04*** | (2006.01) |
| ***B61L 23/14*** | (2006.01) |
| ***E01B 7/00*** | (2006.01) |
| ***B61L 5/10*** | (2006.01) |
| ***B61L 11/08*** | (2006.01) |
| ***B61L 27/00*** | (2006.01) |

(52) U.S. Cl.

CPC ..... *E01B 7/00* (2013.01); *B61L 5/10* (2013.01); *B61L 11/08* (2013.01); *B61L 27/0088* (2013.01)

(58) Field of Classification Search

CPC ..... E01B 7/00; B61L 27/0088; B61L 11/08; B61L 5/10

See application file for complete search history.

(56) References Cited

U.S. PATENT DOCUMENTS

| | | | | |
|---|---|---|---|---|
| 5,947,423 | A * | 9/1999 | Clifton | B61L 3/225 246/167 R |
| 7,343,314 | B2 * | 3/2008 | Matheson | B61L 27/0016 701/19 |
| 2009/0184210 | A1 * | 7/2009 | Groves, Jr. | B61L 19/16 246/3 |
| 2009/0184212 | A1 * | 7/2009 | Allshouse | B61L 27/0038 246/3 |
| 2009/0198391 | A1 * | 8/2009 | Kumar | B60L 3/12 701/2 |
| 2010/0163687 | A1 * | 7/2010 | Brand | B61L 3/127 246/117 |

(Continued)

*Primary Examiner* — Jelani A Smith
*Assistant Examiner* — Majdi Alsomiri
(74) *Attorney, Agent, or Firm* — The Webb Law Firm

(57) ABSTRACT

A switch alignment detection and enforcement system for a switch for a railway track having a normal leg and a reverse leg, the switch having a normal position for entry on the normal leg after the switch and a reverse position for entry on the reverse leg after the switch. The system includes: a first switch monitor device configured to generate at least one signal when the switch is in the normal position; a second switch monitor device configured to generate at least one signal when the switch is in the reverse position; and a train management computer configured or programmed to implement at least one train control action based on: a signal or absence thereof from the first switch monitor device and/or the second switch monitor device; and the content of a form-based authority. A switch alignment detection and enforcement arrangement and method are also disclosed.

26 Claims, 2 Drawing Sheets

(56) References Cited

U.S. PATENT DOCUMENTS

| | | | | |
|---|---|---|---|---|
| 2010/0258682 | A1* | 10/2010 | Fries | B61L 3/121 246/1 C |
| 2011/0035083 | A1* | 2/2011 | Groves | B61L 27/0022 701/19 |
| 2011/0118913 | A1 | 5/2011 | Pretorius et al. | |
| 2011/0172856 | A1* | 7/2011 | Kull | B61L 15/0027 701/19 |
| 2014/0131524 | A1* | 5/2014 | Grimm | B61L 27/00 246/3 |

* cited by examiner

SWITCH ALIGNMENT DETECTION ENFORCEMENT SYSTEM AND METHOD

BACKGROUND OF THE INVENTION

Field of the Invention

This invention relates generally to vehicle systems and networks, such as railway systems including trains travelling in a track or rail network, and in particular to a switch alignment detection and enforcement system and method for use in a vehicle network, preferably a vehicle network of multiple trains operating in a track network, where the track network includes multiple operable switches to facilitate the trains moving between track sections.

Description of Related Art

Vehicle systems and networks exist throughout the world, and, at any point in time, a multitude of vehicles, such as cars, trucks, buses, trains, and the like, are travelling throughout the system and network. With specific reference to trains travelling in a track network, the locomotives of such trains are typically equipped with or operated using train control, communication, and management systems (e.g., positive train control systems), such as the I-ETMS® of Wabtec Corp. In order to effectively manage all of the trains, information and data must be communicated and distributed over the network between the trains, i.e., the locomotives; a central control system, i.e., central dispatch; various wayside devices, e.g., wayside interface units, radios, track communication devices; and/or other equipment positioned throughout the track network.

Further, and as is known, switches and switch arrangements are sections of tracks and movable rails that are used to allow the train to move between and among tracks as it travels along it route, such as moving between a normal leg and a reverse leg. The switches in such systems are monitored to support navigation, and to provide status for protection of a switch that is not properly positioned (or aligned) for a train's authority. In signaled territory, these switches are directly monitored through a wayside interface unit, or may be indirectly monitored by an electrical lock arrangement, as provided through the signal status. However, in "dark" (i.e., non-signaled) territory, switch monitors are generally not available and new infrastructure is or would be required to meet the monitoring requirements of the positive train control system.

FIG. 1 illustrates an existing switch monitoring arrangement for use in dark territory. As shown in FIG. 1, a wayside arrangement (A) is provided, which is used in connection with a switch (S) at a juncture in the track (T). This wayside arrangement (A) includes a circuit controller (CC) as a signal source for a wayside interface unit (WIU) for indicating that the switch (S) is either in the normal or reverse position. A data radio (DR) is integrated or in communication with the wayside interface unit (WIU), and this data radio (DR) conveys or transmits the status of the wayside interface unit (WIU) to an appropriately equipped locomotive, i.e., a train having a train management computer and operating in a positive train control system. Further, a power source (PS) is used to power the devices in the wayside arrangement (A), and may include commercial power (if available), locally-generated wind power, locally-generated solar power, and/or the like. Further, the data radio (DR) transmits the information to a communication device (CD) on a train (TR) (typically the locomotive of the train (TR)), which is controlled by or in communication with a train management computer (TMC).

Switches that are not equipped with such a wayside interface unit, or a faulty wayside interface unit, will not report any status. If the status of a switch is unknown, the train management computer facilitates crew input related to the actual position of the switch, i.e., normal or reverse. This information is critical for proper navigation, but does represent a potential hazard for the train if the actual alignment or position of the switch is incorrectly entered by the crew. Specifically, the train may enter a section of track where it does not have authority, which leads to other potential hazards and safety issues.

There are existing low-cost, low-power devices that connect to a circuit controller and indicate the orientation of the switch. For example, one such available device is the RailFly™ device and system of Convergent Communications, Inc., with reference to U.S. Application Publication No. 2011/0118913. As illustrated in FIG. 2, a known switch monitoring arrangement that uses such a device is illustrated. In particular, the above-discussed circuit controller (CC) is provided and is in electrical communication with the switch (S). Further, this circuit controller (CC) is powered by a power source (PS). A switch monitor device (SMD) or sensor is in electrical communication with the circuit controller (CC), such that the switch monitor device (SMD) receives power through the circuit controller (CC) when the switch (S) is in the "Normal" state, and is unpowered when the switch (S) is in the "Reverse" state. While powered, the switch monitor device (SMD) transmits (through the data radio (DR)) a static value associated with or indicating that the switch (S) is aligned normal, and the configuration of the switch monitor device (SMD) does not facilitate any other message, i.e., it is in either an "on" or "off" (or malfunctioning) state. Such an arrangement is effective for use in connection with a mainline switch, since the PTC system communicating with the switch will either receive a "Normal" indication or no indication. In the case where no indication is received, the PTC system (including the communication device (CD) and train management computer (TMC) of the train (TR)) acts to enforce a stop prior to the unknown switch; and, thereafter, requires that the crew confirm the actual switch alignment. Further, such an arrangement may also be effective in connection with mainline switches where the sidings are non-PTC (i.e., non-signaled) territory, such that there would be no need to protect entry into the siding beyond confirmation by the crew that the train was leaving the PTC track.

Accordingly, the use of such devices and arrangements reduces the cost of installing and using a wayside interface unit, which is used to meet the vital monitoring and reporting requirements. In particular, the safety requirements are met by using such a device since no switch monitoring choice has to be made by the device, or validated through vital processing. Instead, and as discussed, the device can only report a single switch position, i.e., "Normal", and only does so when powered. Accordingly, there remains a hazard associated with incorrect switch position entry by the crew, and, additionally, an operational disruption occurs since the crew must enter the actual switch alignment when it is not received from the device.

While the above-discussed device and arrangement facilitate the effective management of trains through switches in dark territory, there is room in the field of train management for switch alignment detection and enforcement within the track network.

SUMMARY OF THE INVENTION

Generally, provided are an improved computer-implemented method and system for switch alignment detection and enforcement for trains travelling in a track network. Preferably, provided are an improved computer-implemented method and system for switch alignment detection and enforcement that are useful in non-signaled territory. Preferably, provided are an improved computer-implemented method and system for switch alignment detection and enforcement that are economically feasible and do not require an existing installation, e.g., a wayside interface unit. Preferably, provided are an improved computer-implemented method and system for switch alignment detection and enforcement that facilitate efficient and effective switch alignment detection in a variety of environments and applications.

According to one preferred and non-limiting embodiment or aspect, provided is a switch alignment detection and enforcement system for at least one switch for a railway track having a normal leg (e.g., main leg or first section of track) and a reverse leg (e.g., siding leg or second section of track), the switch having a normal position for entry on the normal leg after the switch and a reverse position for entry on the reverse leg after the switch. The system includes: a first switch monitor device in direct or indirect electrical communication with the at least one switch and configured to generate at least one signal when the switch is in the normal position; a second switch monitor device in direct or indirect electrical communication with the at least one switch and configured to generate at least one signal when the switch is in the reverse position; and, on at least one locomotive of a train travelling on the railway track, a train management computer configured or programmed to facilitate or implement at least one train control action based at least partly on the following: at least a portion of the signal or absence thereof from the first switch monitor device; at least a portion of the signal or absence thereof from the second switch monitor device; and at least a portion of the content of a form-based authority.

According to a further preferred and non-limiting embodiment or aspect, provided is a switch alignment detection and enforcement arrangement for at least one switch for a railway track having a normal leg (or first section of track) and a reverse leg (or second section of track), the switch having a normal position for entry on the normal leg after the switch and a reverse position for entry on the reverse leg after the switch. The arrangement includes: a first switch monitor device in direct or indirect electrical communication with the at least one switch and configured to generate at least one signal when the switch is in the normal position; and a second switch monitor device in direct or indirect electrical communication with the at least one switch and configured to generate at least one signal when the switch is in the reverse position.

In a further preferred and non-limiting embodiment or aspect, provided is a switch alignment detection and enforcement method for at least one switch for a railway track having a normal leg and a reverse leg, the switch having a normal position for entry on the normal leg after the switch and a reverse position for entry on the reverse leg after the switch, the method including: configuring or programming a first switch monitor device to generate at least one signal when the switch is in the normal position; configuring or programming a second switch monitor device to generate at least one signal when the switch is in the reverse position; and, on at least one train management computer, facilitating or implementing at least one train control action based at least partly on the following: at least a portion of the signal or absence thereof from the first switch monitor device; at least a portion of the signal or absence thereof from the second switch monitor device; and at least a portion of the content of a form-based authority.

Further preferred and non-limiting embodiments or aspects will now be described in the following numbered clauses:

Clause 1: A switch alignment detection and enforcement system for at least one switch for a railway track having a normal leg and a reverse leg, the switch having a normal position for entry on the normal leg after the switch and a reverse position for entry on the reverse leg after the switch, the system comprising: a first switch monitor device in direct or indirect electrical communication with the at least one switch and configured to generate at least one signal when the switch is in the normal position; a second switch monitor device in direct or indirect electrical communication with the at least one switch and configured to generate at least one signal when the switch is in the reverse position; and on at least one locomotive of a train travelling on the railway track, a train management computer configured or programmed to facilitate or implement at least one train control action based at least partly on the following: at least a portion of the signal or absence thereof from the first switch monitor device; at least a portion of the signal or absence thereof from the second switch monitor device; and at least a portion of the content of a form-based authority.

Clause 2: The system of clause 1, wherein the at least one train control action is further based at least partly on at least one input or lack thereof by a user representing at least one crew action.

Clause 3: The system of clause 1 or clause 2, wherein the train management computer is configured or programmed to permit the train to enter the normal leg after the switch if: the at least one signal of the first switch monitor device is detected or received; and the content of the form-based authority is "Normal Leg".

Clause 4: The system of any of clauses 1-3, wherein the train management computer is configured or programmed to permit the train to enter the reverse leg of the switch if: the at least one signal of the second switch monitor device is detected or received; and the content of the form-based authority is "Reverse Leg".

Clause 5: The system of any of clauses 1-4, wherein the train management computer is configured or programmed to prevent the train from entering the normal leg after the switch if: the at least one signal of the first switch monitor device is detected or received; and the content of the form-based authority is "Reverse Leg".

Clause 6: The system of any of clauses 1-5, wherein the train management computer is configured or programed to prevent the train from entering the reverse leg after the switch if: the at least one signal of the second switch monitor device is detected or received; and the content of the form-based authority is "Normal Leg".

Clause 7: The system of any of clauses 1-6, wherein the train management computer is configured or programmed to: (1) enforce the train to restricted speed through the switch, and (2) enforce for a user input that the train is operating on the normal leg, if: the at least one signal of the first switch monitor device is not detected or received; the at least one signal of the second switch monitor device is not detected or received; the content of the form-based authority is "Normal Leg"; and input of at least one user is "Normal".

Clause 8: The system of any of clauses 1-7, wherein the train management computer is configured or programmed to: (1) enforce the train to restricted speed through the switch; and (2) enforce for a user input that the train is operating on the reverse leg, if: the at least one signal of the first switch monitor device is not detected or received; the at least one signal of the second switch monitor device is not detected or received; the content of the form-based authority is "Reverse Leg"; and input of at least one user is "Reverse".

Clause 9: The system of any of clauses 1-8, wherein the train management computer is configured or programmed to: (1) prevent the train from entering the normal leg after the switch; and (2) enforce for a user input that the train is operating on the normal leg without authority, if: the at least one signal of the first switch monitor device is not detected or received; the at least one signal of the second switch monitor device is not detected or received; the content of the form-based authority is "Reverse Leg"; and input of at least one user is "Normal".

Clause 10: The system of any of clauses 1-9, wherein the train management computer is configured or programmed to: (1) enforce the train to restricted speed on the reverse leg; (2) correct location data for the train; and (3) enforce the train to a stop, if: the at least one signal of the first switch monitor device is not detected or received; the at least one signal of the second switch monitor device is not detected or received; the content of the form-based authority is "Reverse Leg"; input of at least one user is "Reverse"; and a determination that the actual switch alignment is "Normal".

Clause 11: The system of any of clauses 1-10, wherein the train management computer is configured or programmed to: (1) prevent the train from entering the reverse leg after the switch; and (2) enforce for a user input that the train is operating on the reverse leg without authority, if: the at least one signal of the first switch monitor device is not detected or received; the at least one signal of the second switch monitor device is not detected or received; the content of the form-based authority is "Normal Leg"; and input of at least one user is "Reverse".

Clause 12: The system of any of clauses 1-11, wherein the train management computer is configured or programmed to: (1) enforce the train to restricted speed on the normal leg; (2) correct location data for the train; and (3) enforce the train to a stop, if: the at least one signal of the first switch monitor device is not detected or received; the at least one signal of the second switch monitor device is not detected or received; the content of the form-based authority is "Normal Leg"; input of at least one user is "Normal"; and a determination that the actual switch alignment is "Reverse".

Clause 13: The system of any of clauses 1-12, wherein the train management computer is further configured or programmed to: determine whether the train is proceeding at restricted speed; and if the train is not proceeding at the restricted speed, facilitate or implement at least one of the following: an automatic braking operation, initiate at least one alarm, provide at least one indication in a display in the locomotive, or any combination thereof.

Clause 14: The system of any of clauses 1-13, wherein the train management computer is further configured or programmed to: determine whether the train has stopped and a status of at least one of the first switch monitor device and the second switch monitor device assessed; and if the train has not stopped, or the status of at least one of the first switch monitor device or the second switch monitor device has not been determined, facilitate or implement at least one of the following: an automatic braking operation, initiate at least one alarm, provide at least one indication in a display in the locomotive, or any combination thereof.

Clause 15: The system of any of clauses 1-14, wherein the first switch monitor device is configured to receive power from at least one power source and transmit the at least one signal when the switch is in the normal position.

Clause 16: The system of any of clauses 1-15, wherein the second switch monitor device is configured to receive power from at least one power source and transmit the at least one signal when the switch is in the reverse position.

Clause 17: The system of any of clauses 1-16, wherein the train management computer is further configured or programmed to receive the form-based authority from a central dispatch remote server.

Clause 18: The system of any of clauses 1-17, further comprising at least one communication device configured or programmed to directly or indirectly transmit the at least one signal of the first switch monitor device and the at least one signal of the second switch monitor device to at least one of the following: at least one central dispatch remote server, at least one remote server, the at least one train management computer, or any combination thereof.

Clause 19: A switch alignment detection and enforcement arrangement for at least one switch for a railway track having a normal leg and a reverse leg, the switch having a normal position for entry on the normal leg after the switch and a reverse position for entry on the reverse leg after the switch, the arrangement comprising: a first switch monitor device in direct or indirect electrical communication with the at least one switch and configured to generate at least one signal when the switch is in the normal position; and a second switch monitor device in direct or indirect electrical communication with the at least one switch and configured to generate at least one signal when the switch is in the reverse position.

Clause 20: The arrangement of clause 19, wherein receipt of the at least one signal of the first switch monitor device represents or generates an association that the switch is in the normal position.

Clause 21: The arrangement of clause 19 or clause 20, wherein receipt of the at least one signal of the second switch monitor device represents or generates an association that the switch is in the reverse position.

Clause 22: The arrangement of any of clauses 19-21, wherein the first switch monitor device is configured to receive power and transmit the at least one signal when the switch is in the normal position.

Clause 23: The arrangement of clause 22, wherein the power is based upon direct or indirect electrical contact or communication between at least a portion of the first switch monitor device and at least a portion of the switch.

Clause 24: The arrangement of any of clauses 19-23, wherein the second switch monitor device is configured to receive power and transmit the at least one signal when the switch is in the reverse position.

Clause 25: The arrangement of clause 24, wherein the power is based upon direct or indirect electrical contact or communication between at least a portion of the second switch monitor device and at least a portion of the switch.

These and other features and characteristics of the present invention, as well as the methods of operation and functions of the related elements of structures and the combination of parts and economies of manufacture, will become more apparent upon consideration of the following description and the appended claims with reference to the accompanying drawings, all of which form a part of this specification, wherein like reference numerals designate corresponding parts in the various figures. It is to be expressly understood, however, that the drawings are for the purpose of illustration and description only and are not intended as a definition of the limits of the invention. As used in the specification and the claims, the singular form of "a", "an", and "the" include plural referents unless the context clearly dictates otherwise.

DETAILED DESCRIPTION OF THE PREFERRED EMBODIMENTS OR ASPECTS

Figure 1:
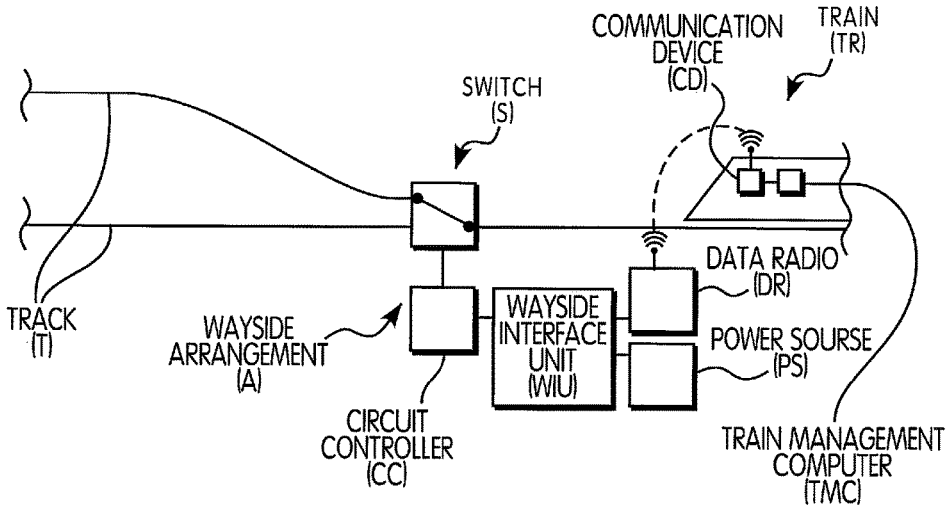
FIG. 1 (Prior Art)
FIG. 1 is a schematic view of a switch location using a wayside interface unit according to the prior art.
Figure 2:
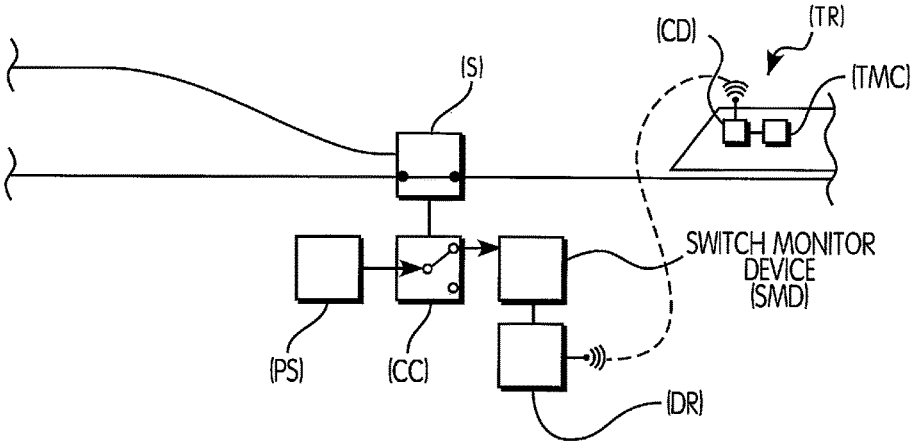
FIG. 2 (Prior Art)
FIG. 2 is a schematic view of a switch location using a switch monitor device according to the prior art.

For purposes of the description hereinafter, the terms "upper", "lower", "right", "left", "vertical", "horizontal", "top", "bottom", "lateral", "longitudinal" and derivatives thereof shall relate to the invention as it is oriented in the drawing figures. It is to be understood that the invention may assume various alternative variations and step sequences, except where expressly specified to the contrary. It is also to be understood that the specific devices and processes illustrated in the attached drawings, and described in the following specification, are simply exemplary embodiments or aspects of the invention. Hence, specific dimensions and other physical characteristics related to the embodiments or aspects disclosed herein are not to be considered as limiting.

As used herein, the terms "communication" and "communicate" refer to the receipt, transmission, or transfer of one or more signals, messages, commands, or other type of data. For one unit or device to be in communication with another unit or device means that the one unit or device is able to receive data from and/or transmit data to the other unit or device. A communication may use a direct or indirect connection, and may be wired and/or wireless in nature. Additionally, two units or devices may be in communication with each other even though the data transmitted may be modified, processed, routed, etc., between the first and second unit or device. For example, a first unit may be in communication with a second unit even though the first unit passively receives data, and does not actively transmit data to the second unit. As another example, a first unit may be in communication with a second unit if an intermediary unit processes data from one unit and transmits processed data to the second unit. It will be appreciated that numerous other arrangements are possible. Any known electronic communication protocols and/or algorithms may be used such as, for example, TCP/IP (including HTTP and other protocols), WLAN (including 802.11 and other radio frequency-based protocols and methods), analog transmissions, and/or the like.

The computer-implemented method and system may be implemented in a variety of systems and vehicular networks; however, the methods and systems described herein are particularly useful in connection with a railway system and network. Accordingly, the presently-invented methods and systems can be implemented in various known train control and management systems, e.g., the I-ETMS® of Wabtec Corp. Accordingly, and in one preferred and non-limiting embodiment, the system architecture used to support the functionality of at least some of the methods and systems described herein includes: a train management computer or on-board computer (which performs calculations for or within the Positive Train Control (PTC) system); a communication device or data radio (which may be used to facilitate the communications between the train management computers in one or more of the locomotives of each train); a track database (which includes information about track positions or locations, switch locations, track heading changes, e.g., curves, distance measurements, train consist information, e.g., the number of locomotives, the number of cars, the total length of the train, and the like); and a navigation system (optionally including Global Positioning System (GPS) and a wheel tachometer/speed sensor).

Figure 3:
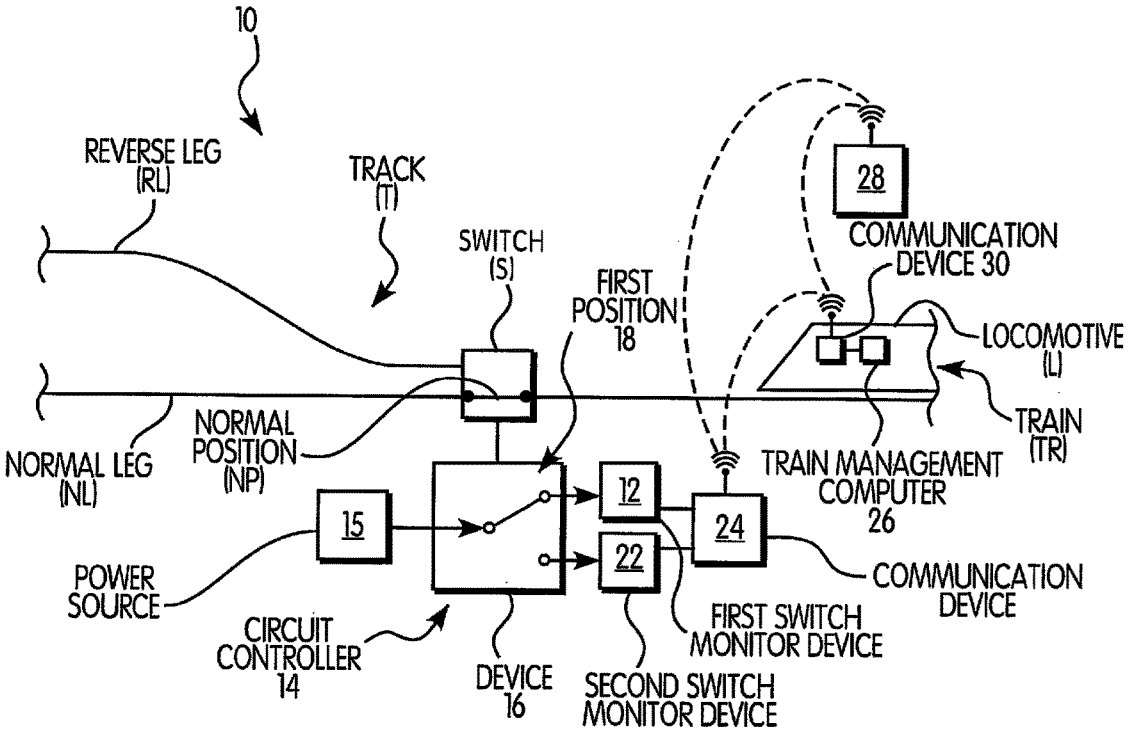
FIG. 3 is a schematic view of one embodiment or aspect of a switch alignment detection and enforcement system and arrangement according to the principles of the present invention.
Figure 4:
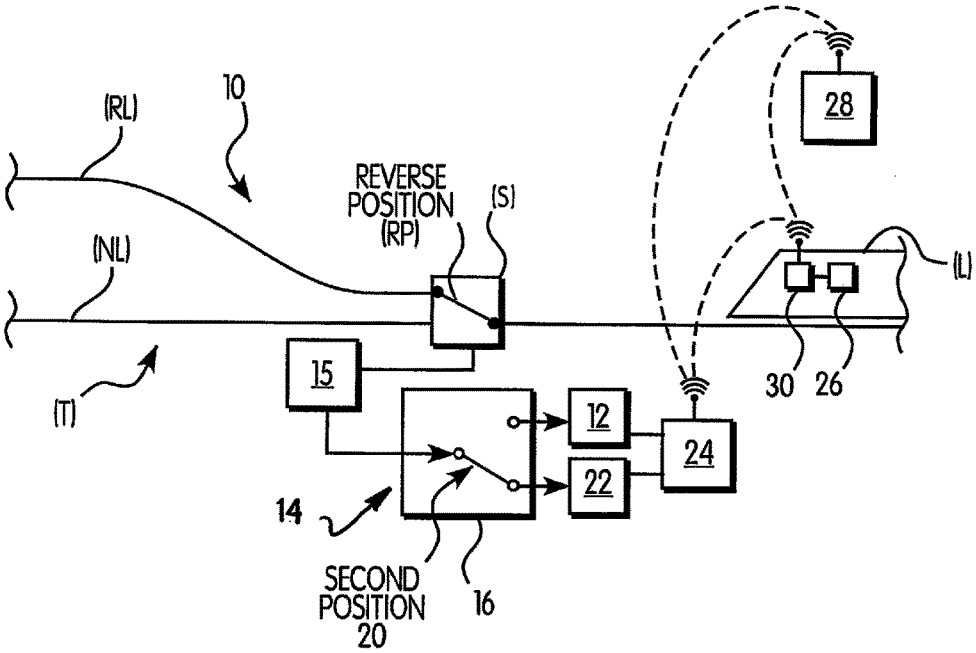
FIG. 4 is a schematic view of another embodiment or aspect of a switch alignment and detection system and arrangement according to the principles of the present invention.

The present invention is directed to a switch alignment detection and enforcement system 10, arrangement, and computer-implemented method, as illustrated in certain preferred and non-limiting embodiments or aspects in FIGS. 3 and 4. In particular, and in one preferred and non-limiting embodiment or aspect, the switch alignment detection and enforcement system 10 for at least one switch (S) for a railway track (T) having a normal leg (NL) (or first section of track (T)) and a reverse leg (RL) (or second section of track (T)). As is known, the switch (S), i.e., the rails, has or is able to be positioned or aligned in a "Normal" position (NP) (e.g., FIG. 3) for entry on or to the normal leg (NL) (or first section of track (T)) after the switch (S), and a "Reverse" position (RP) (e.g., FIG. 4) or alignment for entry on or to the reverse leg (RL) (or second section of track (T)) after the switch (S).

In one preferred and non-limiting embodiment or aspect, and as illustrated in FIGS. 3 and 4, the system 10 includes a first switch monitor device 12 that is in direct or indirect electrical communication with the switch (S), such as through a circuit controller 14 acting as an electrical switch or device 16 with a first position 18 (e.g., FIG. 3) and a second position 20 (e.g., FIG. 4). In this embodiment or aspect, the first position 18 corresponds to or occurs when the switch (S) is in the normal position (NP), such as through direct or indirect electrical communication by or between the circuit controller 14 and the switch (S). Further, the second position 20 corresponds to or occurs when the switch (S) is in the reverse position (RP), again, such as through direct or indirect electrical communication by or between the circuit controller 14 and the switch (S). In addition, the circuit controller 14 is directly or indirectly powered by a power source 15.

The first switch monitor device 12 is configured, programmed, or adapted to generate at least one signal when the switch (S) is in the normal position (NP). In particular, and in this embodiment or aspect, the signal generated by the first switch monitor device 12 results from the circuit controller 14, i.e., the electrical switch or device 16, being in the first position 18 (as seen in FIG. 3). This first switch monitor device 12 may be in the form of a sensor or device that receives input, such as an electrical signal from the circuit controller 14, and generates output, such as an electrical signal, a data signal, an analog signal, a digital signal, a non-transitory signal, a message, data, information, content, and the like.

With continued reference to FIGS. 3 and 4, a second switch monitor device 22 is in direct or indirect electrical communication with the switch (S), again, such as through the circuit controller 14. The second switch monitor device 22 is configured, programmed, or adapted to generate at least one signal when the switch (S) is in the reverse position (RP). In this embodiment or aspect, the signal generated by the second switch monitor device 22 results from the circuit controller 14, i.e., the electrical switch or device 16, being in the second position 20 (as seen in FIG. 4). As discussed above, this second switch monitor device 22 may be in the form of a sensor or device that receives input, such as an electrical signal, from the circuit controller 14, and generates output, such as an electrical signal, a data signal, an analog signal, a digital signal, a non-transitory signal, a message, data, information, content, and the like.

In another preferred and non-limiting embodiment or aspect, the system 10 includes a communication device 24 that is direct or indirect communication with (or integrated with) the first switch monitor device 12 and/or the second switch monitor device 22. Specifically, the communication device 24 may transmit the information: wirelessly, such as in an embodiment or aspect where the communication device 24 is a data radio or the like; or over the rails of the track (T). In this manner, the signal and/or data that is generated by the first switch monitor device 12 and/or the second switch monitor device 22 is transmitted to other components in the system 10, as discussed hereinafter.

Still further, and in another preferred and non-limiting embodiment or aspect, the system 10 includes a train management computer 26 (although, as discussed hereinafter, the various determinations, processes, and methods may be implemented on a specially-programmed computer or server, such as a remote server, a central controller, a central dispatch remote server 28, and the like through program instructions, software, hardware, firmware, and the like). In this embodiment or aspect, the train management computer 26 is in communication with or includes a communication device 30 that is configured, programmed, or adapted to receive the signals, data, and information from the communication device 24, as well as from the central dispatch remote server 28 (as discussed in greater detail hereinafter), whether wirelessly or over the rails of the track (T).

In one embodiment or aspect, the train management computer 26 and the communication device 30 are positioned or located on a locomotive (L) of a train (TR) travelling on the railway track (T). The train management computer 26 (or other specified computer) is configured, programmed, or adapted to facilitate or implement a train control action based at least in part upon: at least a portion of the signal (or data) or absence thereof (i.e., the detection or non-detection (or receipt or non-receipt) of a signal) from the first switch monitor device 12; at least a portion of the signal (or data) or absence thereof (i.e., the detection or non-detection (or receipt or non-receipt) of a signal) from the second switch monitor device 22; and at least a portion of the content of a form-based authority. The form-based authority represents information or a message, such as issued from the central dispatch remote server 28, that provides authority to the train (TR) to occupy or travel on the normal leg (NL) (or first section of track (T)) and/or the reverse leg (RL) (or second section of track (T)). Accordingly, and as explained more fully hereinafter, by using the signals (or absence thereof) from two switch monitor devices 12, 22, as opposed to only a single switch monitor device, in combination with the content of the form-based authority, provided is a robust, effective, and accurate switch alignment detection and enforcement system 10.

It is further noted that the absence of a signal from a switch monitor device 12, 22 could mean either: (1) the switch monitor device 12, 22 is not generating or transmitting a signal as it is not being powered through the circuit controller 14 (or directly or indirectly through the switch arrangement), which means that the switch 16 is not in the corresponding orientation or position, e.g., a representation of "No Status"; or (2) the switch monitor device 12, 22 has failed or is inoperative (which means that it is receiving power from or through the circuit controller 14, but, for some reason, is not generating or transmitting a signal, e.g., a representation of "No Status; Failure Mode"). However, as the train management computer 26 cannot ascertain the difference between these states, additional train (TR) and/or crew control actions will be facilitated or implemented, as discussed in detail hereinafter.

In one preferred and non-limiting embodiment or aspect, the train control action that is facilitated or implemented is additionally based at least partially upon input, or lack thereof, by a user representing at least one crew action. Specifically, and through interaction between the crew and the train (TR) (e.g., between the crew and the train management computer 26 (or interface)), a train action is facilitated or implemented, such as emergency braking, braking restrictions, speed restrictions, and/or other train control actions and functions.

In another preferred and non-limiting embodiment or aspect, the train management computer 26 is configured, programmed, or adapted to permit (i.e., not facilitate or implement a braking action for) the train (TR) to enter the normal leg (NL) after the switch (S) if: the signal of the first switch monitor device 12 is, represents, or indicates "No Defect" (i.e., a signal (or data) is detected or received from the first switch monitor device 12), e.g., a "Clear" signal from a track circuit monitor arrangement; and the content of the form-based authority is "Normal Leg" (which means that the train (TR) is permitted to occupy the normal leg (NL) of the track (T)). Further, the train management computer 26 is configured, programmed, or adapted to permit the train (TR) to enter the reverse leg (RL) of the switch (S) if: the signal of the second switch monitor device 22 is, represents, or indicates "No Defect" (i.e., a signal (or data) is detected or received from the second switch monitor device 22); and the content of the form-based authority is "Reverse Leg" (which means that the train (TR) is permitted to occupy the reverse leg (RL) of the track (T)).

In another preferred and non-limiting embodiment or aspect, the train management computer 26 is configured, programmed, or adapted to prevent the train (TR) (e.g., facilitate or implement a braking action, initiate emergency braking, and the like) from entering the normal leg (NL) after the switch (S) if: the signal of the first switch monitor device 12 is "No Defect" (i.e., a signal (or data) is detected or received from the first switch monitor device 12); and the content of the form-based authority is "Reverse Leg". Further, the train management computer 26 is configured, programmed, or adapted to prevent the train (TR) from entering the reverse leg (RL) after the switch (S) if: the signal of the second switch monitor device 22 is "No Defect" (i.e., a signal (or data) is detected or received from the first switch monitor device 12); and the content of the form-based authority is "Normal Leg".

In another preferred and non-limiting embodiment or aspect, the train management computer 26 is configured, programed, or adapted to: (1) enforce the train (TR) to restricted (or some reduced) speed through the switch (S) and (2) enforce for a user input that the train (TR) is operating on the normal leg (NL) if: the signal of the first switch monitor device 12 is not detected (or not received) (e.g., resulting from a failure in the first switch monitor device 12); the signal of the second switch monitor device 22 is not detected (or not received); the content of the form-based authority is "Normal Leg"; and input of at least one user is "Normal". With respect to the input of the user, this refers to the input of the crew or operator in the train management computer 26 indicating that it is believed that the switch (S) is oriented in the normal position (NP) or alignment for entering the normal leg (NL) of the track (T) after the switch (S). Therefore, when these conditions are satisfied, the train (TR) is enforced to restricted speed through the switch (S).

In a further preferred and non-limiting embodiment or aspect, the train management computer 26 is configured, programmed, or adapted to: (1) enforce the train (TR) to restricted speed through the switch (S); and (2) enforce for a user (i.e., crew) input that the train (TR) is operating on the reverse leg (RL) of the track (T) if: the signal of the first switch monitor device 12 is not detected (or not received); the signal of the second switch monitor device 22 is not detected (or not received); the content of the form-based authority is "Reverse Leg"; and input of the user is "Reverse". In this embodiment or aspect, the train management computer 26 is further configured, programmed, or adapted to: (1) prevent the train (TR) from entering the normal leg (NL) after the switch (S); and (2) enforce for a user input that the train (TR) is operating on the normal leg (NL) without authority, if the signal of the first switch monitor device 12 is not detected (or not received); the signal of the second switch monitor device 22 is not detected (or not received); the content of the form-based authority is "Reverse Leg"; and the input of the user is "Normal".

In another preferred and non-limiting embodiment or aspect, the train management computer 26 is configured, programmed, or adapted to: (1) enforce the train (TR) to restricted speed on the reverse leg (RL) of the track (T); (2) correct location data for the train (TR); and (3) enforce the train (TR) to a stop, if the signal of the first switch monitor device 12 is not detected (or not received) (e.g., resulting from a failure in the first switch monitor device 12); the signal of the second switch monitor device 22 is not detected (or not received); the content of the form-based authority is "Reverse Leg"; input of the user is "Reverse"; and a determination is made that the actual switch (S) alignment is "Normal". Further, in this embodiment or aspect, the train management computer 26 is configured, programmed, or adapted to: (1) prevent the train (TR) from entering the reverse leg (RL) after the switch (S); and (2) enforce for a user input that the train (TR) is operating on the reverse leg (RL) of the track (T) without authority if: the signal of the first switch monitor device 12 is not detected (or not received); the signal of the second switch monitor device 22 is not detected (or not received) (e.g., resulting from a failure in the first switch monitor device 22); the content of the form-based authority is "Normal Leg"; and input of the user is "Reverse".

In a further preferred and non-limiting embodiment or aspect, the train management computer 26 is configured, programmed, or adapted to: (1) enforce the train (TR) to restricted speed on the normal leg (NL) of the track (T); (2) correct location data for the train; and (3) enforce the train (TR) to a stop, if: the signal of the first switch monitor device 12 is not detected (or not received); the signal of the second switch monitor device 22 is not detected (or not received) (e.g., resulting from a failure in the first switch monitor device 22); the content of the form-based authority is "Normal Leg"; input of the user is "Normal"; and a determination is made that the actual switch (S) alignment is "Reverse".

In a further preferred and non-limiting embodiment or aspect, the train management computer 26 is further configured, programmed, or adapted to: determine whether the train (TR) is proceeding at restricted speed; and, if the train (TR) is not proceeding at the restricted speed, facilitate or implement at least one of the following: an automatic braking operation (e.g., an emergency braking process), initiate at least one alarm (e.g., an aural and/or visual alarm), provide at least one indication in a display in the locomotive (L) (e.g., on an operator interface, which is part of or in communication with the train management computer 26 system), or any combination thereof. In another preferred and non-limiting embodiment or aspect, the train management computer 26 is further configured, programmed, or adapted to: determine whether the train (TR) has stopped (such as may be required based upon the switch (S) alignment) and the status of the first switch monitor device 12 and/or the second switch monitor device 22 assessed, such as in response to non-detection or non-receipt of an expected signal or message; and, if the train (TR) has not stopped, or the status of the first switch monitor device 12 and/or the second switch monitor device 22 has not been determined, facilitate or implement at least one of the following: an automatic braking operation, initiate at least one alarm, provide at least one indication in a display in the locomotive (L), or any combination thereof.

In one preferred and non-limiting embodiment or aspect, and as discussed, the first switch monitor device 12 is configured to receive power directly or indirectly from a power source, such as the power source 15, and transmit the signal when the switch (S) is in the normal position (NP) or aligned for entry to the normal leg (NL) of the track (T), and the second switch monitor device 22 is configured to receive power from a power source, such as the power source 15, and transmit the signal when the switch (S) is in the reverse position (RP) or aligned for entry to the reverse leg (RL) of the track (T). Further, this power source may be the same power source that powers the circuit controller 14, the switch (S), and/or any component in the system 10, thereby not requiring a separate power source to be installed for use in connection with the system 10 at these switch locations. In another preferred and non-limiting embodiment or aspect, either of the communication devices (24, 30) are configured, programmed, or adapted to directly or indirectly transmit the signals (whether wirelessly or over the rails of the track (T)) and data by and between any two or more of the first switch monitor device 12, the second switch monitor device 22, the train management computer 26, the central dispatch remote server 28, or any combination thereof.

In a further preferred and non-limiting embodiment or aspect, provided is a switch alignment detection and enforcement method for at least one switch (S) for a railway track (T) having a normal leg (NL) and a reverse leg (RL). As discussed, the switch (S) has a normal position (NP) for entry on the normal leg (NL) after the switch (S) and a reverse position (RP) for entry on the reverse leg (RL) after the switch (S). In this embodiment or aspect, the method includes: configuring, programming, or adapting a first switch monitor device 12 to generate at least one signal when the switch (S) is in the normal position (NP); configuring, programming, or adapting a second switch monitor device 22 to generate at least one signal when the switch (S) is in the reverse position (RP); and, on at least one train management computer 26, facilitating or implementing at least one train control action based at least partly on the following: at least a portion of the signal or absence thereof from the first switch monitor device 12; at least a portion of the signal or absence thereof from the second switch monitor device 22; and at least a portion of the content of a form-based authority. This method can be implemented in connection with the system 10 and arrangements discussed herein.

In one exemplary embodiment or aspect, the presently-invented system 10 and method implements the simplicity of the use of a switch monitor device (12, 22) with the reduction or elimination of the requirement that the crew input the switch (S) orientation or alignment. The use of two such switch monitor devices (12, 22) to monitor the normal position (NP) or reverse position (RP) of the switch (S) is a novel innovation, as well as the configuration, transmittals, determinations, and methodology for using the transmitted data to control train (TR) movement towards and through the switch (S). As discussed above, and in this exemplary embodiment or aspect, only one switch monitor device (12, 22) is powered at a single point in time, i.e., corresponding to the normal position (NP) or reverse position (RP) of the switch (S), but both or either switch monitor device (12, 22) is configured, programmed, or adapted to report status through a single communication device 24 to the train management computer 26 (through the communication device 30).

In this exemplary embodiment or aspect, it is noted that the known PTC data model includes a database schema (which provides information for use at the central dispatch remote server 28 and the train management computer 26 of each train (TR)) that addresses the need for all geographic information required for the PTC system, e.g., the I-ETMS® system, to operate. A portion of that information includes the wayside interface unit status for switches (S). Accordingly, for unambiguous reporting, each switch (S) has a single address through which either "Normal" or "Reverse" status would be reported. In this exemplary embodiment or aspect, the need for a single address would prevent two switch monitor devices (12, 22) devices from providing status for a single location, such that an alternative approach can be implemented to align the PTC Data Model with an implementation of two switch monitor devices (12, 22).

With continued reference to this exemplary embodiment or aspect, the system 10 and method can be effectively implemented in connection with a known PTC Data Model, with particular relation to track circuit monitors. Such track circuit monitors and devices, normally used in dark territory, are typically used for broken rail detection; but, in connection with this invention, can be used for any track where a "No Defect" condition needs to be monitored. Therefore, in this exemplary embodiment or aspect, the present invention is implemented to take advantage of the recognition that track circuit monitors report switch (S) position. In particular, and as discussed above, in this exemplary embodiment or aspect, the system 10 and method includes: assigning the first switch monitor device 12 as a first track circuit monitor to the normal leg (NL) of the switch (S); assigning the second switch monitor device 22 as a second track circuit monitor to the reverse leg (RL) of the same switch (S); connecting the first switch monitor device 12 to the circuit controller 14, such that the first switch monitor device 12 is powered when the switch (S) is in the normal position (NP), wherein, when powered, the first switch monitor device 12 indicates that the track circuit is clear with no defect; and connecting the second switch monitor device 22 to the circuit controller 14, such that the second switch monitor device 22 is powered when the switch (S) is in the reverse position (RP), wherein, when powered, the second switch monitor device 22 indicates the track circuit is clear with no defect.

In addition, and in this exemplary embodiment or aspect, the train management computer 26 is programmed, configured, or adapted such that the monitoring logic indicates that a "No Defect" report (i.e., a detection of the signal from the switch monitor device 12, 22) on one leg of a switch (S) indicates alignment of the switch (S) in that leg's orientation, i.e., "No Defect" on the normal leg (NL) indicates a normal orientation of the switch (S), and "No Defect" on the reverse leg (RL) indicates reverse orientation of the switch (S). Further, the current on-board logic (on the train management computer 26) determines that no report from a track circuit monitor is considered as a "Defect Detected" condition. This basic design, with minimal changes to current on-board logic, allows two switch monitor devices (12, 22) to provide switch (S) state status using two addresses associated to a single device.

As discussed above, the use of a single switch monitor device leads to the hazard that would permit a crew member to select an incorrect switch (S) orientation. While the use of two switch monitor devices (12, 22) resolves the nominal case that forces crew entry of the switch (S) state during normal operations, there remains the case where a faulty device would require crew entry of switch (S) state in order to allow movement with valid navigation. This remaining safety issue would no longer be part of routine operation, and instead represents an exception case. For this reason, the proposed mitigation may be to hold the train (T) to restricted speed. The restricted speed limitation should continue until an unambiguous navigation solution can be determined. In one preferred and non-limiting embodiment or aspect, this mitigation may be implemented using inertial sensor feedback that confirms the train (T) path through the switch (S), navigation through a converging switch (S), passing a track circuit monitor, or some other confirmation method.

With continued reference to this exemplary embodiment or aspect, Table 1 indicates the system 10 and method behavior under nominal operations, and Table 2 indicates the full set of combinations that can be obtained from the first and second switch monitor device (12, 22) implementation with indication of any restriction that should be applied to address the potential hazard of incorrect crew input of switch position.

TABLE 1

Nominal State Safety Analysis

| Actual Switch Alignment | Form-Based Authority | Normal Leg First Switch Monitor Device Indication | Reverse Leg Second Switch Monitor Device Indication | Crew Action | Safety Assessment |
|---|---|---|---|---|---|
| Normal | Normal | Clear (No Defect) | No Status | None Required | Safe operation, no enforcement |
| | Reverse | Clear (No Defect) | | None Required | Safe Operation - System enforces for no authority on normal |
| Reverse | Normal | No Status | Clear (No Defect) | None Required | Safe Operation - System enforces for no authority on reverse |
| | Reverse | | Clear (No Defect) | None Required | Safe operation, no enforcement |

TABLE 2

| Failure Response Safety Analysis | | | | | |
|---|---|---|---|---|---|
| Actual Switch Alignment | Form-Based Authority | Normal Leg First Switch Monitor Device Indication | Reverse Leg Second Switch Monitor Indication | Crew Action | Safety Assessment |
| Normal | Normal | No Status (Failure mode) | No Status | Crew selects "Normal" | No hazard present, but train is still held to Restricted Speed. No enforcement unless crew exceeds Restricted Speed. |
| | | | | Crew incorrectly selects "Reverse" | No hazard present, but train is still held to Restricted Speed, then enforced for crew indication that train is running on reverse where there is no authority. |
| | Reverse | No Status (Failure mode) | | Crew selects "Normal" | Potential hazard for continuing on Normal when authority is only present for reverse. Train is still held to Restricted Speed, then enforced for crew indication that train is running on normal where there is no authority. |
| | | | | Crew incorrectly selects "Reverse" | Potential hazard for continuing on Main when authority is only present for reverse. Train is held to Restricted Speed while running onto the reverse where no authority is present. Once confirmation of incorrect switch orientation choice has been detected, the system will correct location and immediately enforce for not having authority in corrected location. |

TABLE 2-continued

| Failure Response Safety Analysis | | | | | |
|---|---|---|---|---|---|
| Actual Switch Alignment | Form-Based Authority | Normal Leg First Switch Monitor Device Indication | Reverse Leg Second Switch Monitor Indication | Crew Action | Safety Assessment |
| Reverse | Main | No Status | No Status (Failure mode) | Crew selects "Reverse" | Potential hazard for continuing on reverse when authority is only present for normal. Train is still held to Restricted Speed, then enforced for crew indication that train is running on reverse where there is no authority. |
| | | | | Crew incorrectly selects "Normal" | Potential hazard for continuing on reverse when authority is only present for main. Train is held to Restricted Speed while running on the normal where no authority is present. Once confirmation of incorrect switch orientation choice has been detected, the system will correct location and immediately enforce for not having authority in corrected reverselocation. |
| | Reverse | | No Status (Failure mode) | Crew selects "Reverse" | No hazard present, but train is still held to Restricted Speed. No enforcement unless crew exceeds Restricted Speed. |
| | | | | Crew incorrectly selects "Normal" | No hazard present, but train is still held to Restricted Speed, then enforced for crew indication that train is running on normal where there is no authority. |

In this manner, the present invention provides an improved switch alignment detection and enforcement system and method.

Although the invention has been described in detail for the purpose of illustration based on what is currently considered to be the most practical and preferred embodiments or aspects, it is to be understood that such detail is solely for that purpose and that the invention is not limited to the disclosed embodiments or aspects, but, on the contrary, is intended to cover modifications and equivalent arrangements that are within the spirit and scope of the appended claims. For example, it is to be understood that the present invention contemplates that, to the extent possible, one or more features of any embodiment or aspect can be combined with one or more features of any other embodiment or aspect.

What is claimed is:

1. A switch alignment detection and enforcement system for a switch for a railway track having a normal leg and a reverse leg, the switch having a normal position for entry on the normal leg after the switch and a reverse position for entry on the reverse leg after the switch, the system comprising:

a first switch monitor device in electrical communication with the switch and configured to generate at least one signal based on the switch being in the normal position;

a second switch monitor device in electrical communication with the switch and configured to generate at least one signal based on the switch being in the reverse position;

a power source configured to supply power directly or indirectly to the first and second switch monitor devices;

a circuit controller located between the power source and the first and second switch monitor devices, the circuit controller configured to provide electrical communication from the switch to the first switch monitor device and to the second switch monitor device, wherein the circuit controller is switchable between a first position in which power is supplied via the power source to the first switch monitor device to generate the at least one signal based on the switch being in the normal position, and a second position in which power is supplied via the power source to the second switch monitor device to generate the at least one signal based on the switch being in the reverse position; and on at least one locomotive of a train travelling on the railway track, a train management computer configured or programmed to facilitate or implement at least one train control action based at least partly on the following:

at least a portion of the signal or absence thereof from the first switch monitor device;

at least a portion of the signal or absence thereof from the second switch monitor device; and at least a portion of content of a form-based authority.

2. The system of claim 1, wherein the at least one train control action is further based at least partly on at least one input or lack thereof by a user representing at least one crew action.

3. The system of claim 1, wherein the train management computer is configured or programmed to permit the train to enter the normal leg after the switch if:

the at least one signal of the first switch monitor device is detected or received; and the content of the form-based authority is "Normal Leg".

4. The system of claim 1, wherein the train management computer is configured or programmed to permit the train to enter the reverse leg of the switch if:

the at least one signal of the second switch monitor device is detected or received; and the content of the form-based authority is "Reverse Leg".

5. The system of claim 1, wherein the train management computer is configured or programmed to prevent the train from entering the normal leg after the switch if:

the at least one signal of the first switch monitor device is detected or received; and the content of the form-based authority is "Reverse Leg".

6. The system of claim 1, wherein the train management computer is configured or programmed to prevent the train from entering the reverse leg after the switch if:

the at least one signal of the second switch monitor device is detected or received; and the content of the form-based authority is "Normal Leg".

7. The system of claim 1, wherein the train management computer is configured or programmed to: (1) enforce the train to restricted speed through the switch, and (2) enforce for a user input that the train is operating on the normal leg, if:

the at least one signal of the first switch monitor device is not detected or received;

the at least one signal of the second switch monitor device is not detected or received;

the content of the form-based authority is "Normal Leg"; and input of at least one user is "Normal".

8. The system of claim 1, wherein the train management computer is configured or programmed to: (1) enforce the train to restricted speed through the switch; and (2) enforce for a user input that the train is operating on the reverse leg, if:

the at least one signal of the first switch monitor device is not detected or received;

the at least one signal of the second switch monitor device is not detected or received;

the content of the form-based authority is "Reverse Leg"; and input of at least one user is "Reverse".

9. The system of claim 1, wherein the train management computer is configured or programmed to: (1) prevent the train from entering the normal leg after the switch; and (2) enforce for a user input that the train is operating on the normal leg without authority, if:

the at least one signal of the first switch monitor device is not detected or received;

the at least one signal of the second switch monitor device is not detected or received;

the content of the form-based authority is "Reverse Leg"; and input of at least one user is "Normal".

10. The system of claim 1, wherein the train management computer is configured or programmed to: (1) enforce the train to restricted speed on the reverse leg; (2) correct location data for the train; and (3) then enforce the train to a stop, if:

the at least one signal of the first switch monitor device is not detected or received;

the at least one signal of the second switch monitor device is not detected or received;

the content of the form-based authority is "Reverse Leg";

input of at least one user is "Reverse"; and a determination that the actual switch alignment is "Normal".

11. The system of claim 1, wherein the train management computer is configured or programmed to: (1) prevent the train from entering the reverse leg after the switch; and (2) enforce for a user input that the train is operating on the reverse leg without authority, if:

the at least one signal of the first switch monitor device is not detected or received;

the at least one signal of the second switch monitor device is not detected or received;

the content of the form-based authority is "Normal Leg"; and input of at least one user is "Reverse".

12. The system of claim 1, wherein the train management computer is configured or programmed to: (1) enforce the train to restricted speed on the normal leg; (2) correct location data for the train; and (3) then enforce the train to a stop, if:

the at least one signal of the first switch monitor device is not detected or received;

the at least one signal of the second switch monitor device is not detected or received;

the content of the form-based authority is "Normal Leg";

input of at least one user is "Normal"; and a determination that the actual switch alignment is "Reverse".

13. The system of claim 1, wherein the train management computer is further configured or programmed to:

determine whether the train is proceeding at restricted speed; and if the train is not proceeding at the restricted speed, facilitate or implement at least one of the following: an automatic braking operation, initiate at least one alarm, provide at least one indication in a display in the locomotive, or any combination thereof.

14. The system of claim 1, wherein the train management computer is further configured or programmed to:

determine whether the train has stopped and a status of at least one of the first switch monitor device and the second switch monitor device; and if the train has not stopped, or the status of at least one of the first switch monitor device or the second switch monitor device has not been determined, facilitate or implement at least one of the following: an automatic braking operation, initiate at least one alarm, provide at least one indication in a display in the locomotive, or any combination thereof.

15. The system of claim 1, wherein the first switch monitor device is configured to receive power from at least one power source and transmit the at least one signal when the switch is in the normal position.

16. The system of claim 1, wherein the second switch monitor device is configured to receive power from at least one power source and transmit the at least one signal when the switch is in the reverse position.

17. The system of claim 1, wherein the train management computer is further configured or programmed to receive the form-based authority from a central dispatch remote server.

18. The system of claim 1, further comprising at least one communication device configured or programmed to directly or indirectly transmit the at least one signal of the first switch monitor device and the at least one signal of the second switch monitor device to at least one of the following: at least one central dispatch remote server, at least one remote server, the at least one train management computer, or any combination thereof.

19. A switch alignment detection and enforcement arrangement for a switch for a railway track having a normal leg and a reverse leg, the switch having a normal position for entry on the normal leg after the switch and a reverse position for entry on the reverse leg after the switch, the arrangement comprising:

a first switch monitor device in electrical communication with the switch and configured to generate at least one signal based on the switch being in the normal position;

a second switch monitor device in electrical communication with the switch and configured to generate at least one signal based on the switch being in the reverse position;

a power source configured to supply power directly or indirectly to the first and second switch monitor devices; and a circuit controller located between the power source and the first and second switch monitor devices, the circuit controller configured to provide electrical communication from the switch to the first switch monitor device and to the second switch monitor device, wherein the circuit controller is switchable between a first position in which power is supplied via the power source to the first switch monitor device to generate the at least one signal based on the switch being in the normal position, and a second position in which power is supplied via the power source to the second switch monitor device to generate the at least one signal based on the switch being in the reverse position.

20. The arrangement of claim 19, wherein receipt of the at least one signal of the first switch monitor device represents or generates an association that the switch is in the normal position.

21. The arrangement of claim 19, wherein receipt of the at least one signal of the second switch monitor device represents or generates an association that the switch is in the reverse position.

22. The arrangement of claim 19, wherein the first switch monitor device is configured to receive power and transmit the at least one signal when the switch is in the normal position.

23. The arrangement of claim 22, wherein the power is based upon electrical contact or communication between at least a portion of the first switch monitor device and at least a portion of the switch.

24. The arrangement of claim 19, wherein the second switch monitor device is configured to receive power and transmit the at least one signal when the switch is in the reverse position.

25. The arrangement of claim 24, wherein the power is based upon electrical contact or communication between at least a portion of the second switch monitor device and at least a portion of the switch.

26. A switch alignment detection and enforcement method for a switch for a railway track having a normal leg and a reverse leg, the switch having a normal position for entry on the normal leg after the switch and a reverse position for entry on the reverse leg after the switch, the method comprising:

configuring or programming a first switch monitor device to generate at least one signal based on the switch being in the normal position;

configuring or programming a second switch monitor device to generate at least one signal based on the switch being in the reverse position; and on at least one train management computer, facilitating or implementing at least one train control action based at least partly on the following: at least a portion of the signal or absence thereof from the first switch monitor device; at least a portion of the signal or absence thereof from the second switch monitor device; and at least a portion of content of a form-based authority, wherein a circuit controller is configured to provide electrical communication from the switch to the first switch monitor device and to the second switch monitor device, the circuit controller switchable between a first position in which power is supplied via a power source to the first switch monitor device to generate the at least one signal based on the switch being in the normal position, and a second position in which power is supplied via the power source to the second switch monitor device to generate the at least one signal based on the switch being in the reverse position; and wherein the circuit controller is located between the power source and the first and second switch monitor devices.

* * * * *